US005806818A

United States Patent [19]

Heywood

[11] Patent Number: 5,806,818

[45] Date of Patent: Sep. 15, 1998

[54] PAINT ACCESSORY

[76] Inventor: Carl B. Heywood, 111 Central Ave., N. Versailles, Pa. 15137

[21] Appl. No.: 885,269

[22] Filed: Jun. 30, 1997

[51] Int. Cl.[6] ..... A47B 96/06

[52] U.S. Cl. ..... 248/213.2; 248/110; 248/112

[58] Field of Search ..... 248/213.2, 112, 248/113, 110, 302, 303, 304, 339, 700

[56] References Cited

U.S. PATENT DOCUMENTS

| | | | |
|---|---|---|---|
| 2,315,269 | 3/1943 | Morgillo | 248/110 |
| 3,729,158 | 4/1973 | Nagy | 248/110 |
| 3,948,413 | 4/1976 | Gorrell et al. | 248/110 |
| 4,014,453 | 3/1977 | Tarnacki | 248/110 |
| 4,025,206 | 5/1977 | Rubin | 248/112 |
| 4,275,818 | 6/1981 | Church | 248/110 |
| 4,757,568 | 7/1988 | Jones | 248/110 |
| 4,991,803 | 2/1991 | Buder | 248/213.2 |
| 5,035,386 | 7/1991 | Tucker | 248/303 |
| 5,085,386 | 2/1992 | Hicks et al. | 248/110 |
| 5,087,014 | 2/1992 | Desjardin | 248/213.2 |

*Primary Examiner*—Ramon O. Ramirez
*Assistant Examiner*—Anita M. King
*Attorney, Agent, or Firm*—James Ray & Assocs.

[57] ABSTRACT

The present invention provides an apparatus which is engageable with at least a portion of a rim portion of an open paint can for holding a paint brush in a predetermined position which is at least one of over and within an opening of such paint can when such paint brush is not in use. Such apparatus comprises an arcuately shaped member having a predetermined length and a predetermined degree of curvature for securing such apparatus to such rim portion of such paint can in an operable position. Such arcuately shaped member includes a tongue portion having an arcuate shape in a length dimension. Such tongue portion being generally U-shaped in a depth dimension and is engagable within a groove portion of such rim portion of such paint can and into which a portion of a lid is disposed in a closed paint can. Such apparatus further includes an inverted L-shaped rod like member having a generally vertically disposed leg portion and a generally horizontally disposed leg portion positionable over an open paint can during use of such apparatus. Such apparatus also has a securing mechanism connected to an outwardly facing portion of such arcuately shaped member for securing such inverted L-shaped rod like member into an operating position during such use of such apparatus.

12 Claims, 2 Drawing Sheets

PAINT ACCESSORY

FIELD OF THE INVENTION

The present invention relates, in general, to accessories benificial in painting and, more particularly, the present invention relates to a paint brush holder that is engagable with a rim of an opened paint can and holds a paint brush while not in use in a position to permit the paint on such brush to drip into the can.

BACKGROUND OF THE INVENTION

The art or occupation of painting has been with us for countless years. Whether its a person painting the rooms in his own house or a painter who works for his livelihood by painting, there is a common problem that is encountered. This is a problem of what to do with the paintbrush that contains paint when one must stop painting for whatever reason. There are countless interruptions that occur during a painting operation.

These interruptions can be the same interruptions that frequently occur when doing any chore or work such as answering the telephone, responding to the door bell, getting a drink of water or whatever. However, in painting there is always the aforementioned problem of what to do with the paintbrush. Normally a painter lays his brush across the top of the can when there is an interruption that forces him to stop painting. In doing so he must be certain that most of the paint is removed from the brush so it will not drip anywhere but in the can. Or the painter may lay the brush on its side in a roller tray, if a paint roller is also being used. None of these are ideal answers to "what to do with the paint brush" problem.

There is also the problem of what to do with the brush when one has to move from one location to another. A painter can hold the brush in one hand and the paint can in the other or he can lay the brush across the top of the can and use one hand to carry the can and brush and risk having the brush slip off the can and possibly fall and get paint on a surface not intended to be painted.

Thus, there is a need for a device or apparatus that could hold the brush without a danger of dropping the brush or spilling paint when an interruption occurs during a painting operation.

SUMMARY OF THE INVENTION

The present invention provides an apparatus which is engageable with at least a portion of a rim portion of an open paint can for holding a paint brush in a predetermined position which is at least one of over and within an opening of such paint can when such paint brush is not in use. Such apparatus comprises an arcuately shaped means having a predetermined length and a predetermined degree of curvature for securing such apparatus to such rim portion of such paint can in an operable position. Such arcuately shaped means includes a tongue portion having an arcuate shape in a length dimension. Such tongue portion being generally U-shaped in a depth dimension and is engagable within a groove portion of such rim portion of such paint can and into which a portion of a lid is disposed in a closed paint can. Such apparatus further includes an inverted L-shaped rod like member having a generally vertically disposed leg portion and a generally horizontally disposed leg portion positionable over an open paint can during use of such apparatus. Such generally vertically disposed leg portion has a first predetermined configuration and such generally horizontally disposed leg portion has second predetermined configuration. Such apparatus also has a securing means connected to an outwardly facing portion of such arcuately shaped means for securing such inverted L-shaped rod like member into an operating position during such use of such apparatus.

OBJECTS OF THE INVENTION

It is, therefore, one of the primary objects of the present invention to provide a paint brush holder that mounts directly on the rim of an opened paint can and holds the paint brush while not in use.

It is also an object of the present invention to provide a paint brush holder that permits the brush to drip into the can when not in use.

It is an additional object of the present invention to provide a paint brush holder that is adjustable so the height of the arm holding the brush above the paint can be readily changed. It is a further object of the present invention to provide a paint brush holder that is adaptable for different size paint cans.

In addition to the number of objects and advantages of the present invention which have been discussed above, it should be noted that various other objects and advantages of the paint brush holder for a variety of applications will become more readily apparent to those persons who are particularly skilled in the art from the following more detailed description of such invention.

BRIEF DESCRIPTION OF THE PRESENTLY PREFERRED EMBODIMENT OF THE INVENTION

Figure 1:
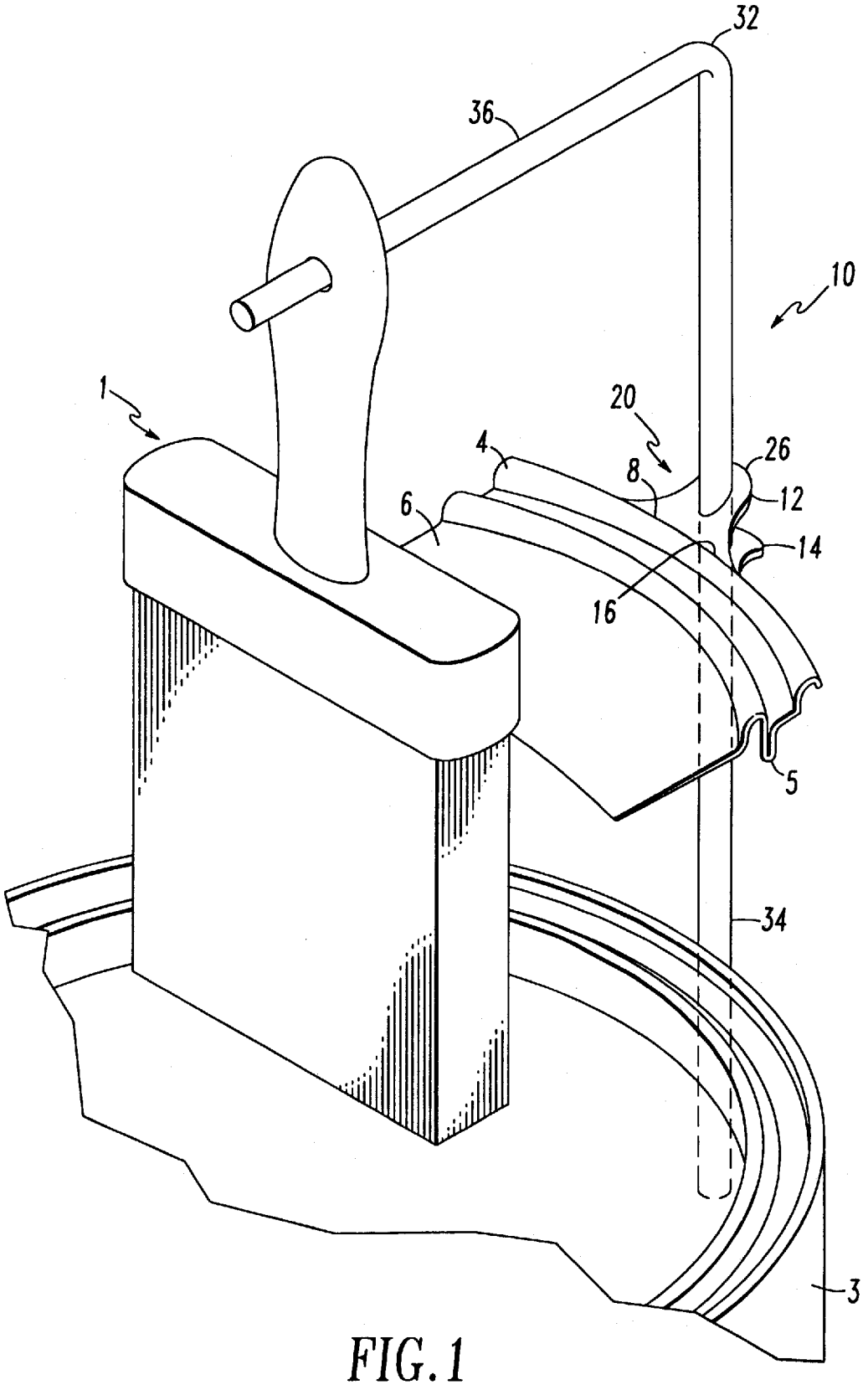
FIG. 1 is a drawing showing the relationship of the present invention to a paintbrush and a paint can rim.

Prior to proceeding to the more detailed description of the present invention, it should be noted that for the sake of clarity in understanding the invention, identical components with identical functions have been designated with identical reference numerals throughout the drawing Figures.

Figure 2:
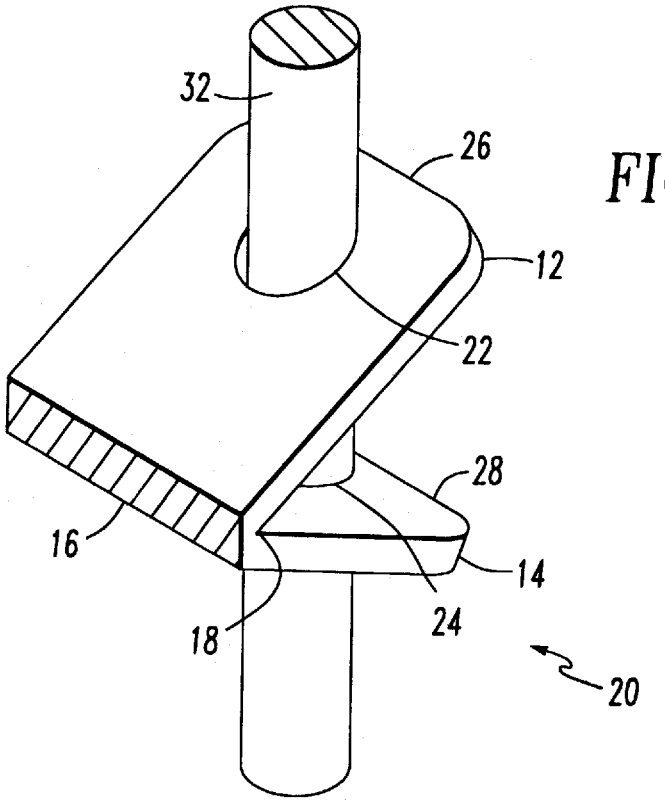
FIG. 2 is a drawing showing the part of the paint brush holder that holds the rod.

Reference is now made more particularly to FIGS. 1 and 2. Illustrated therein are drawings of the present invention of a paint brush holder, generally designated 10, and its relationship to a paint brush 1 and a portion of the rim of a paint can 3. Neither the paint brush 1 nor the portion of a paint can rim 3 are part of the present invention but are just shown to give the perspective of the instant invention.

In a preferred embodiment of the invention, the paint brush holder 10 has a first means 4 which has a predetermined length and has an arcuate shape in such lengthwise direction. First means 4 (also referred to as arcuately shaped means) has a tongue portion 5 which is generally U-shaped in a depth dimension. Such tongue portion 5 is designed to fit securely into the groove of a portion of rim 3 of a paint can. The groove of the portion of rim 3 is where a lid would be disposed in a closed paint can. First means 4 as mentioned previously has a predetermined length and arcuate shape. Such curvature is designed to be the substantially the same as the curvature or arcuate shape of a paint can.

In an other embodiment of the invention such first arcuately shaped means 4 further includes a lip portion 6 connected to such tongue portion 5 and which extends into such paint can for a predetermined distance. Such lip portion 6 also has a predetermined length and an arcuate shape. The arcuate shape of such lip portion 6 is similar to the arcuate shape of such first means 4 and such tongue portion 5 in a length dimension and is designed to be the same as the curvature or arcuate shape of a paint can. Such lip portion 6 has a second degree of curvature in a depth dimension. Thus, lip portion 6 has a predetermined length and arcuate shape and has second degree of curvature as it extends into such paint can for a predetermined distance.

Paint brush holder 10 further has a rod-like member 32 which has a shape like an inverted L. Rod-like member 32 has a generally vertically disposed leg portion 34 and a generally horizontally disposed leg portion 36 positionable over an open paint can during use of such apparatus. The horizontal leg 36 of the rod 32 is disposed over such opened paint can and is designed to hold paint brush 1. Such generally vertically disposed leg portion 34 has a first predetermined configuration and such generally horizontally disposed leg portion 36 has a second predetermined configuration. In a presently preferred embodiment of the invention such first and such second predetermined configuations are substantially identical. Such configurations are one of round, square, hexagonal and octagonal. It is presently preferred that such configuration is round.

Paint brush holder 10 further includes a securing means, generally designated 20, connected to an outwardly facing portion 8 of such arcuately shaped first means 4 for securing such inverted L-shaped rod like member 32 into an operating position during such use of such apparatus.

In a presently preferred embodiment of the invention the paint brush holder 10 of the instant invention, securing means 20 has a first projected planer surface 12 and a second projected planer surface 14 extending outward. A first end 16 of first projected planer surface 12 and a first end 18 of second projected planer surface 14 are attached to such outwardly facing portion 8 of first means 4 at a common location.

First projected planer surface 12 and second projected planer surface 14 extend outward from outwardly facing portion 8 of first means 4 in different planes so as to form a predetermined angle at the common location on outwardly facing portion 8 of first means 4 where first end 16 of first projected planer surface 12 and first end 18 of second projected planer surface 14 are attached.

First projected planer surface 12 and second projected planer surface 14 of securing means 20 have an aperture 22 and 24, respectively at a predetermined location. In a presently preferred embodiment such location is positioned closely adjacent a second end 26 of first projected planer surface 12 and closely adjacent a second end 28 of second projected planer surface 14. Vertical leg 34 of rod-like member 32 is disposed through and secured by aperture 22 on first projected planer surface 12 and aperture 24 on second projected planer surface 14.

When rod 32 is inserted through apertures 22 on first projected planer surface 12 and aperture 24 on second projected planer surface 14 the angle at which the planer surfaces 12 and 14, respectively, are disposed permits planer surfaces 12 and 14 to hold onto rod 32 and not permit rod-like member 32 to slip. Further, the height at which horizontal leg 36 rests above the open paint can is easily adjusted by moving vertical leg 34 up or down through apertures 22 and 24.

When paint brush 1 is placed on such horizontal leg 36 of rod-like member 32, the brush is held above the paint in the opened paint can. Thus, the brush will drip into the paint and there is very little danger of spilling paint onto a surface that isn't to be painted or even possibly getting paint on the handle of the brush. If desired, horozontal leg 36 could be lowered by moving vertical leg 34 of rod-like member 32 so that the tip of the bristles of paint brush 1 could be immersed into the paint so that such paint on the brush would not dry if the brush 1 is to be left there for an extended period of time.

With paint brush 1 retained on horizontal leg 36 of rod-like member 32, it is possible to transport the paint can and also the paint brush 1 with one hand leaving the other hand free. Again the danger of spillage in moving the paint can from one location to another is reduced significantly and the painter has one hand free to also carry a ladder, if its small, or a step stool at the same time or to open a door without the need of setting the paint can or the brush down.

Figure 3:
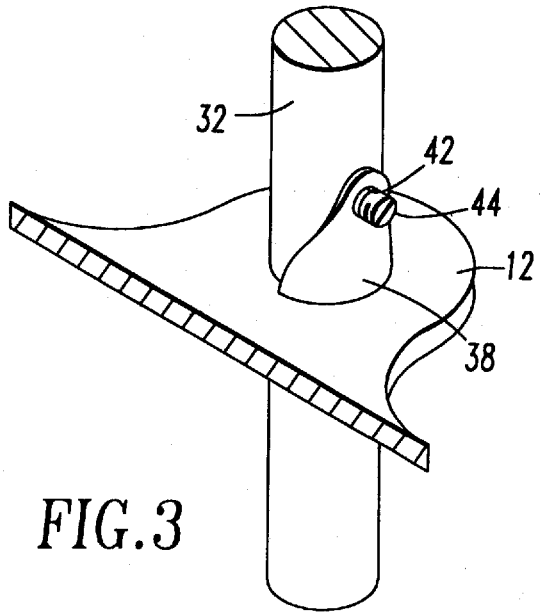
FIG. 3 is a drawing of a paint brush holder showing an alternate embodiment of the invention.

Reference is now made to FIG. 3, illustrated therein is an alternate embodiment of the invention. In this embodiment first projected planer surface 12 of securing means 20 has a lip 38 which extends outward from planer surface 12. Lip 38 further has a threaded aperture 42 and a set screw 44 in the threaded aperture 42. Set screw 44 is designed to press against the vertical leg 34 of rod-like member 32 to hold rod-like member 32 in place. In this embodiment securing means 20 can operate with only first projected planer surface 12 without having a second projected planer surface 14. In this embodiment first projected planer surface 14 may extend outward from outwardly facing portion 8 of first means 4 in a generally horizontal plane.

It is still within the scope of the invention wherein securing means 20 has both projected planer surface 12 and projected planer surface 14. Planer surface 12 has such lip portion 38 and threaded aperture 42 with set screw 44 designed to press against vertical leg 34 of rod-like member 32 to further secure rod-like member 34. It is also within the scope of the invention where such lip portion 38 and threaded aperture 42 could be disposed on second planer surface 14. However, the access to such set screw 44 is much easier if such lip portion 38 and threaded aperture 42 are disposed on first planer surface 12 and if such lip portion 38 extends upwardly from such first planer surface 12.

While a number of presently preferred and various alternative embodiments of the present invention have been described in detail above, various other adaptations and modifications of the paint brush holder may be made by those persons who are skilled in the painting art without departing from either the spirit of the invention or the scope of the appended claims.

I claim:

1. An apparatus which is engageable with at least a portion of a rim portion of an open paint can for holding a paint brush in a predetermined position which is at least one of over and within an opening of such paint can when such paint brush is not in use, said apparatus comprising:

(a) an arcuately shaped means having a predetermined length and a predetermined degree of curvature for securing said apparatus to the rim portion of the paint can in an operable position, said arcuately shaped means including a tongue portion having an arcuate shape in a length dimension and said tongue portion being generally U-shaped in a depth dimension, said tongue portion being engagable within a groove portion of such rim portion of such paint can and into which a portion of a lid is disposed in a closed paint can;

(b) an inverted L shaped rod like member having a generally vertically disposed leg portion and a generally horizontally disposed leg portion, said generally horizontally disposed leg portion disposable over an open paint can during use of said apparatus, said generally vertically disposed leg portion having a first predetermined configuration and said generally horizontally disposed leg portion having a second predetermined configuration; and (c) a securing means connected to an outwardly facing portion of said arcuately shaped means for securing said inverted L-shaped rod like member into an operating position during such use of said apparatus.

2. The apparatus which is engageable with at least a portion of a rim portion of an open paint can for holding a paint brush, according to claim 1, wherein said arcuately shaped means includes a lip portion connected to said tongue portion and which is extendable into the paint can for a predetermined distance, said lip portion having a second predetermined length and an arcuate shape substantially identical to said arcuate shape of said tongue portion in such length direction and a second degree of curvature in such depth dimension.

3. The apparatus which is engageable with at least a portion of a rim portion of an open paint can for holding a paint brush, according to claim 1, wherein said securing means includes a means for enabling said substantially horizontal leg portion of said inverted L-shaped rod like member to be adjusted in a substantially vertical direction.

4. The apparatus which is engageable with at least a portion of a rim portion of an open paint can for holding a paint brush, according to claim 1, wherein said securing means includes at least one projected planer surface extending outwardly from said outwardly facing portion of said arcuately shaped means, a first end of said projected planer surface is secured to said outwardly facing portion of said arcuately shaped means, said at least one projected planer surface of said securing means includes an aperture formed therethrough at a predetermined location for securing said generally vertically disposed leg portion of said inverted L shaped rod like member.

5. The apparatus which is engageable with at least a portion of a rim portion of an open paint can for holding a paint brush, according to claim 4, wherein said at least one projected planer surface further includes a threaded lip portion adjacent said aperture and a set screw threadably engaged therein, said set screw engagable with said substantially vertical leg portion of said inverted L-shaped rod like member for securing said inverted L-shaped rod like member.

6. The apparatus which is engageable with at least a portion of a rim portion of an open paint can for holding a paint brush, according to claim 5, wherein said at least one projected planer surface of said securing means is disposed on a generally horizontal plane.

7. The apparatus which is engageable with at least a portion of a rim portion of an open paint can for holding a paint brush, according to claim 4, wherein said securing means further includes a first projected planer surface and a second projected planer surface extending outwardly from said outwardly facing portion of said arcuately shaped means, a first end of said first projected planer surface and a first end of said second projected planer surface are attached to said outwardly facing portion of said arcuately shaped means at a common location and wherein said first projected planer surface and said second projected planer surface each extend outwardly in a different plane so as to form a predetermined angle at said common location on said outwardly facing portion of said arcuately shaped means where said first end of said first projected planer surface and said first end of said second projected planer surface are attached and wherein each of said first projected planer surface and said second projected planer surface have an aperture formed therethrough at a predetermined location for securing said generally vertically disposed leg portion of said inverted L shaped rod-like member.

8. The apparatus which is engageable with at least a portion of a rim portion of an open paint can for holding a paint brush, according to claim 7, wherein said predetermined location of said aperture formed through said first projected planer surface and said second projected planer surface is positioned closely adjacent a second end of said first projected planer surface and closely adjacent a second end of said second projected planer surface, said second end being opposite said first end.

9. The apparatus which is engageable with at least a portion of a rim portion of an open paint can for holding a paint brush, according to claim 7, wherein said first projected planer surface further includes a threaded lip portion adjacent said aperture and having a set screw threadably engaged therein and engagable with said substantially vertical leg portion of said inverted L-shaped rod like member for securing said inverted L-shaped rod like member.

10. The apparatus which is engageable with at least a portion of a rim portion of an open paint can for holding a paint brush, according to claim 1, wherein said first predetermined configuration of said vertically disposed leg portion and said second predetermined configuration of said generally horizontally disposed leg portion are substantially identical.

11. The apparatus which is engageable with at least a portion of a rim portion of an open paint can for holding a paint brush, according to claim 10, wherein said first predetermined configuration and said second predetermined configuration are one of round, square, hexagonal, and octagonal.

12. The apparatus which is engageable with at least a portion of a rim portion of an open paint can for holding a paint brush, according to claim 11, wherein said first predetermined configuration of said vertically disposed leg portion and said second predetermined configuration of said generally horizontally disposed leg portion are substantially round.

* * * * *

UNITED STATES PATENT AND TRADEMARK OFFICE

CERTIFICATE OF CORRECTION

PATENT NO. : 5,806,818
DATED : September 15, 1998
INVENTOR(S) : Carl B. Heywood

It is certified that error appears in the above-identified patent and that said Letters Patent is hereby corrected as shown below:

Column 1, line 6, please delete "benificial" and insert –beneficial--;
Column 1, line 18, after "for" please delete "whatever" and insert –any--;
Column 1, line 25, after "water" please delete "or whatever" and insert --,etc.--;
Column 1, line 30, after "so" please insert –that--;
Column 1, line 33, after "to" please insert --the--.
Column 2, line 1, after "has" please insert –a--;
Column 2, line 64, after "be" please delete "the".
Column 3, line 10, after "has" please insert --a--;
Column 3, line 49, after "respectively" please insert --,--.
Column 5, line 2, after "portion" please delete –disposable" and insert –disposed--.

Signed and Sealed this

Ninth Day of November, 1999

*Attest:*

Q. TODD DICKINSON

*Attesting Officer*

*Acting Commissioner of Patents and Trademarks*